US005885128A

United States Patent [19]

Blaustein et al.

[11] Patent Number: 5,885,128

[45] Date of Patent: Mar. 23, 1999

[54] PLUSH TOY WITH A MAJOR THROUGH-STITCH IN AN OUTER CASING PROVIDING MOVABLE CONNECTED PARTS

[75] Inventors: Lawrence A. Blaustein, Moreland Hills, Ohio; Susan E. Trentel, Lakewood, Okla.

[73] Assignee: Lawrence Product Development, Inc., Cleveland, Ohio

[21] Appl. No.: 911,782

[22] Filed: Aug. 15, 1997

[51] Int. Cl.[6] ..... A63H 3/02; A63H 3/46

[52] U.S. Cl. ..... 446/369; 446/384

[58] Field of Search ..... 446/369, 371, 446/372, 304, 322, 384, 278, 317, 364

[56] References Cited

U.S. PATENT DOCUMENTS

| | | | |
|---|---|---|---|
| D. 84,732 | 7/1931 | Bennett | 446/369 X |
| 1,435,267 | 11/1922 | Vathe | 446/369 |
| 1,682,832 | 9/1928 | Cohn | 446/304 X |
| 1,754,558 | 4/1930 | Ivey | 446/371 |
| 4,296,567 | 10/1981 | Kamar | 446/369 |
| 4,439,202 | 3/1984 | Sernaker . | |
| 4,575,351 | 3/1986 | Gonzolez | 446/369 X |
| 4,722,712 | 2/1988 | McKenna . | |
| 4,799,889 | 1/1989 | Yockey . | |
| 4,800,600 | 1/1989 | Baum . | |
| 4,968,281 | 11/1990 | Smith et al. | 446/369 |
| 5,178,574 | 1/1993 | Evoy . | |
| 5,184,362 | 2/1993 | Yager et al. . | |
| 5,478,988 | 12/1995 | Hughes et al. . | |
| 5,542,122 | 8/1996 | Moldovan . | |
| 5,713,780 | 2/1998 | Gallagher | 446/317 X |

FOREIGN PATENT DOCUMENTS

| | | | |
|---|---|---|---|
| 380960 | 9/1932 | United Kingdom | 446/304 |

*Primary Examiner*—Kien T. Nguyen
*Assistant Examiner*—D. Neal Muir
*Attorney, Agent, or Firm*—Calfee, Halter & Griswold LLP

[57] ABSTRACT

The invention is a plush toy formed by an outer casing sewn to form a body filled with a stuffing material and having a head or other appendage attached to the body along a major through-stitch at one edge of the body, wherein the major through-stitch excludes the stuffing material so that the head or appendage has great freedom of motion relative to the body about the major through-stitch. In a preferred embodiment, the major through-stitch is generally linear and oriented generally vertically between the head and body, thereby holding the head free to wag side to side relative to the body in a plane generally perpendicular to the stitch, and whereby oscillation of the body in a plane perpendicular to the stitch induces free wagging of the head about the major through-stitch. A massive secondary object may be attached to the head or appendage connected to the major through-stitch in order to exaggerate the free lateral motion and oscillation about the major through-stitch.

14 Claims, 1 Drawing Sheet

PLUSH TOY WITH A MAJOR THROUGH-STITCH IN AN OUTER CASING PROVIDING MOVABLE CONNECTED PARTS

FIELD OF THE INVENTION

The present invention pertains generally to toys and amusement devices and, more particularly, to plush toys made of a soft inner material such as foam encased with fabric which is textured, colored, sewn and adorned to represent creatures or objects.

BACKGROUND OF THE INVENTION

Plush toys such as stuffed animals are made of a soft inner material or stuffing such as foam which is held within an exterior fabric shell or skin which has simulated fur. Commonly, the outer fabric is sewn or constructed about the stuffing to resemble the shape of an animal such as a dog with a body, legs, tail and a head. The various limbs of plush animal toys are commonly formed simply as rigid appendages to the main body and stuffed with the same material, or mechanically attached to fittings mounted on the main body. Although these methods of construction are suitable to form facsimiles of animals or creatures including each of the various body parts, the result is not always as life-like as possible. Other design factors contribute to the overall appearance and physical characteristics of plush toys. For example, the density of the stuffing material dictates softness or rigidity, and the length and nap of the exterior material can give a plush animal toy a more realistic look and feel.

The present invention provides a plush toy in the form of an animal constructed in a manner which enables animated movement of a major body appendage such as the head relative to the body. In accordance with one aspect of the invention, a plush toy in the form of an animal is constructed with an exterior material layer sewn into several cavities representing various body parts such as legs, a tail and a head. The cavities are filled with a plush material such as conformable foam. A major through-stitch is provided in the exterior material between the body and the head thereby dividing the cavities which define the body and head. Because there is no plush filling material in the area of the major through-stitch, the connected filled cavities of the head and body are relatively articulated by the major through-stitch, such that the head and body are freely relatively movable about the axis of the major through-stitch.

In accordance with a further aspect of the invention, a separate body or object is articulably attached to the head at a point distant from the major through-stitch to provide increased mass and inertia to movement of the head relative to the body.

These and other novel aspects of the invention are herein described in particularized detail with reference to the accompanying Figures which depict a particular embodiment of the invention which may be equivalently executed in other forms.

DETAILED DESCRIPTION OF A PREFERRED EMBODIMENT

As shown in the Figures, one embodiment of the invention is a plush toy, indicated generally at 10, which may be in the form of an animal such as a dog or cat or any other creature or inanimate object. The outer casing 12 may be any suitable flexible material such as cloth or vinyl or leather, and texturized to simulate fur or skin. The outer casing 12 has an exterior side 12*e* and an interior side 12*i* and is cut and sewn or otherwise configured at selected locations to form various interconnected body parts such as a body B (also referred to herein as the torso), legs L, a tail T and a head H. The body parts are formed as cavities within the outer casing which is stuffed or filled with a soft, deformable or malleable primary stuffing material S such as foam or fabric, or alternatively can be stuffed with small particles such as beans or pellets.

Some of the body parts which extend from the torso, such as the legs L, are formed simply as constricted areas of the outer casing 12, and terminated at foot pads F sewn to the outer casing. Other appendages, such as the tail T or ears E, may be sewn to the outer casing about a circuitous line of attachment, indicated at 15, which forms an opening to the interior cavity defined by the outer casing. The appendage is thus filled with the stuffing contained within the outer casing, as is the opening to the appendage within the circuitous line of attachment 15. These types of appendages or body parts are thereby substantially fixed and rigid relative to the body B. Although the appendages are plush as a result of the contained stuffing, they cannot be easily or readily displaced relative to the torso.

Figure 1:
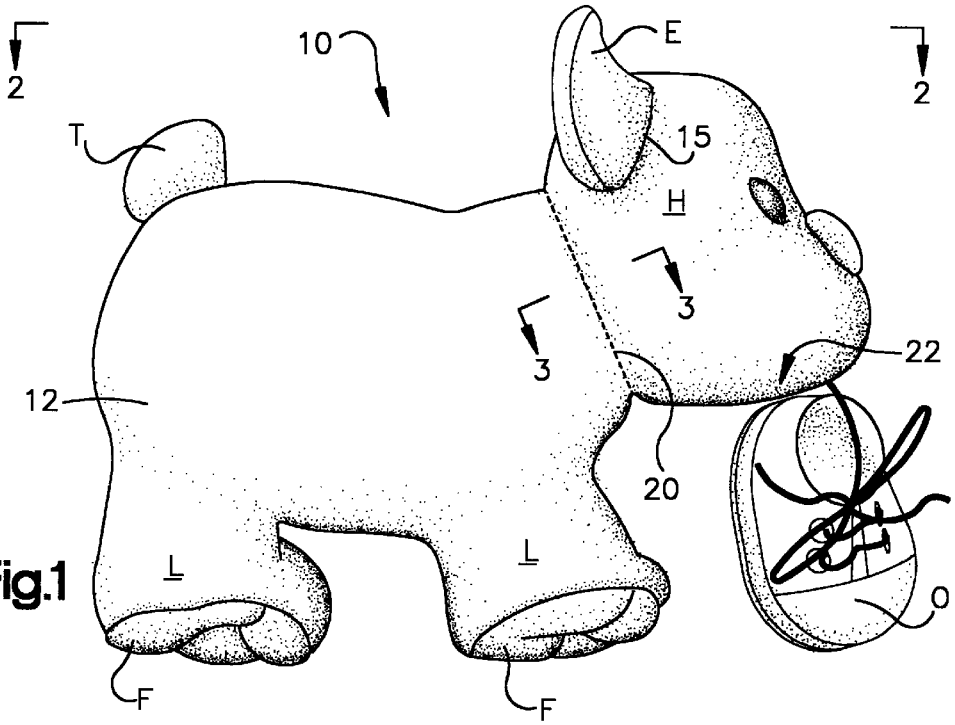
FIG. 1 is a side elevation of a plush toy constructed in accordance with the present invention.
Figure 2:
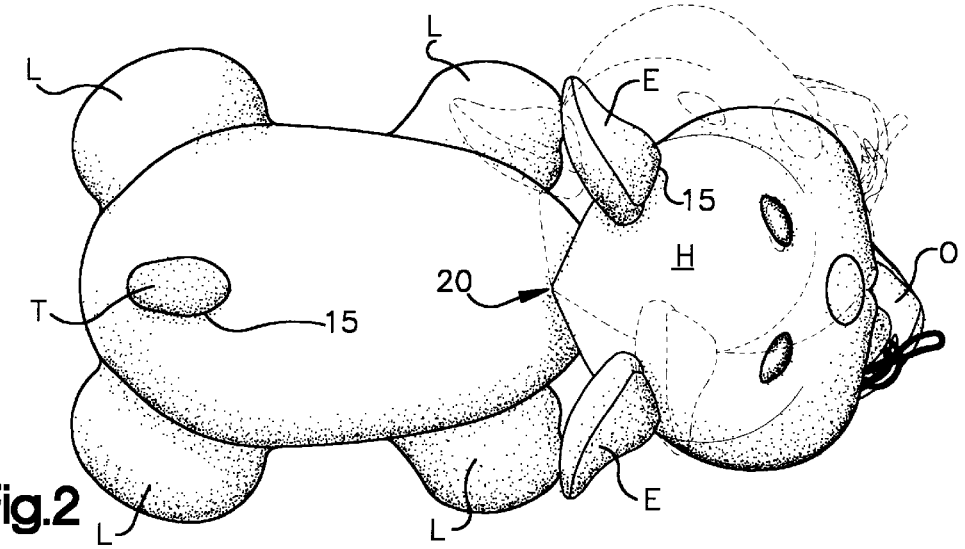
FIG. 2 is a top view of the plush toy of FIG. 1, in the direction of the arrows 2—2 in FIG. 1.
Figure 3:
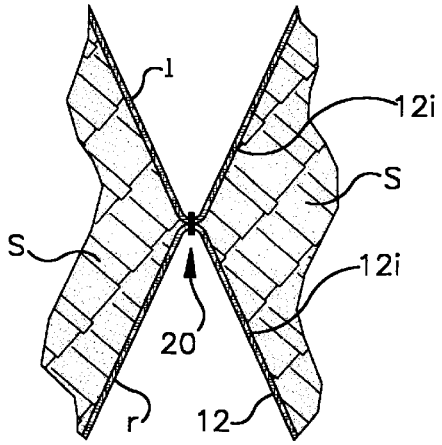
FIG. 3 is a partial cross-sectional top view of the plush toy of FIG. 1, taken in the direction of the arrows 3—3 in FIG. 1.

Quite differently, the head H in the preferred embodiment of this invention, is attached to the body B along a major through-stitch 20 which passes completely through the outer casing 12 from the exterior right side r to the exterior left side l, drawing the corresponding areas of the interior sides 121 of the casing tightly together, with no stuffing material S between the interior sides of the outer casing held together by the major through-stitch 20. The major through-stitch 20 thus forms a generally linear neck between the head H and the body B about which the head is free to displace bilaterally, as shown displaced in phantom to the left in FIG. 2. Of course full displacement to the left is also enabled but not shown. In other words, the absence of stuffing material S at the major through-stitch 20 renders the head H a highly displacable and laterally unstable appendage relative to the body. The major through-stitch 20 is positioned at an edge of body B, and the generally linear axis of the major through-stitch is generally vertically oriented with the plush toy in the upright position shown. With this novel construction, even a slight lateral oscillation of the body B induces vigorous or even violent reactive oscillation of the head, in high animation of, for example, the rapid head-shaking characteristic of aggressive canines. With the body or torso dimensioned to fit within an average hand grip, the head-shaking action enabled by the major through-stitch is easily and readily achieved.

The free lateral displacement of the head about the major through stitch is augmented by attachment at point 22 of a secondary object O to the head, preferably at a distal point the head such as, in the case of a dog, in the frontal teeth. As illustrated, a three-dimensionally animated shoe is attached at a single point proximate the snout of the head and suspended freely therefrom. In operation, as lateral shaking of the head is induced about the major through-stitch, it is exaggerated by the mass of the secondary object which is pulled or drawn through a full range of lateral displacement, in and out of phase with the head. The secondary object may be of any configuration, and is preferably filled with a secondary stuffing material which is relatively more dense and relatively greater per unit mass than the stuffing material S in the head. The secondary object may be attached directly or indirectly to the head H, at one or more points, in any manner suitable to transfer the mass inertia of the object to the head.

The invention thus provides a plush toy with highly animated action provided by the motion of any appendage attached to a main body or other appendage along the described major through-stitch. The motion is exaggerated and further animated by the attachment of a secondary object to the appendage attached along the major through-stitch. Although shown in one particular and preferred embodiment, the invention is applicable to any plush toy in the form of any animate or inanimate object with appendages, and where free motion of an appendage is desired.

What is claimed is:

1. A plush toy having an outer casing closed to form an internal cavity, the internal cavity substantially filled with a stuffing material, the outer casing and stuffing material forming a body, at least one appendage extending from the body, the appendage attached to the body by a major through-stitch which extends from one side of the outer casing to an opposing side of the outer casing with no stuffing material between the opposing sides of the outer casing at the major through-stitch, whereby the appendage is articulated to translate in a generally arcuate path in essentially a single plane relative to the body, and a secondary object attached to the appendage at a single point by loose connection means whereby the object is free to dangle and loosely translate about the point relative to the appendage.

2. The plush toy of claim 1 wherein the major through-stitch is generally linear.

3. The plush toy of claim 1 further comprising appendages to the body which are attached to the body along a generally circuitous path which also provides an opening from an interior cavity of the body formed by the outer casing to an interior cavity of the appendage attached along the generally circuitous path.

4. The plush toy of claim 1 wherein the secondary object is substantially filled with a secondary stuffing material, and wherein the secondary stuffing material is relatively more dense than the primary stuffing material.

5. The plush toy of claim 2 wherein the generally linear major through-stitch is oriented generally vertically relative to an upright position of the plush toy.

6. A plush toy comprising an outer casing having an interior side and an exterior side and configured to form a body with the outer casing surrounding the body and filled with a stuffing material which occupies cavities within the outer casing, and appendages extending from the body, at least one appendage attached to the body along a major through-stitch which extends from one exterior side of the casing to a generally opposite exterior side of the casing, and which draws areas of the corresponding interior sides of the casing tightly together, thereby excluding any stuffing material at the major through-stitch, whereby the appendage is articulated to translate in an arcuate path in essentially a single plane relative to the body, and a secondary object attached to the appendage at a single point by loose connection means whereby the object dangles from the appendage and is free to loosely translate about the point relative to the appendage.

7. The plush toy of claim 6 wherein the secondary object is stuffed with a secondary stuffing material which is relatively more dense than the stuffing material in the body.

8. A plush toy comprising an outer casing having an exterior side and an interior side, the outer casing configured to form a cavity within the casing with the interior side of the casing facing the cavity, a portion of one edge of the cavity formed by a major through-stitch which passes through two layers of the casing, the interior sides of the two layers of casing being held in contact at the major through-stitch, and both layers of the casing extending from the major through-stitch away from the cavity and forming an appendage attached to the cavity by the major through-stitch, whereby the appendage is articulated about the major through-stitch to translate in an arcuate path in essentially a single plane relative to the body, and a secondary object attached to the appendage at a flexible connection point whereby the object is loosely translatable about the point relative to the appendage.

9. The plush toy of claim 8 wherein the cavity is filled with a stuffing material.

10. The plush toy of claim 8 wherein the appendage is filled with a stuffing material.

11. The plush toy of claim 8 further comprising a secondary object attached to the appendage.

12. The plush toy of claim 8 wherein the secondary object has a greater per unit mass than the appendage.

13. The plush toy of claim 8 further comprising appendages formed by the casing 20 which extend from the cavity removed from the major through-stitch.

14. The plush toy of claim 8 wherein the major through-stitch is generally linear and oriented generally vertically relative to an upright position of the plush toy, whereby oscillation of the cavity of the plush toy induces oscillation of the appendage in a plane generally perpendicular to the major through-stitch.

* * * * *